US011280076B2

(12) United States Patent
Oberholzer et al.

(10) Patent No.: US 11,280,076 B2
(45) Date of Patent: Mar. 22, 2022

(54) SIPHON

(71) Applicant: GEBERIT INTERNATIONAL AG, Jona (CH)

(72) Inventors: Marco Oberholzer, Eschenbach (CH); Martin Furrer, Bauma (CH)

(73) Assignee: GEBERIT INTERNATIONAL AG, Jona (CH)

( * ) Notice: Subject to any disclaimer, the term of this patent is extended or adjusted under 35 U.S.C. 154(b) by 5 days.

(21) Appl. No.: 16/607,938

(22) PCT Filed: Nov. 15, 2017

(86) PCT No.: PCT/EP2017/079294
§ 371 (c)(1),
(2) Date: Oct. 24, 2019

(87) PCT Pub. No.: WO2018/197026
PCT Pub. Date: Nov. 1, 2018

(65) Prior Publication Data

US 2020/0063414 A1 Feb. 27, 2020

(30) Foreign Application Priority Data

Apr. 25, 2017 (EP) ..... 17167952

(51) Int. Cl.
*E03C 1/284* (2006.01)
*E03C 1/29* (2006.01)

(52) U.S. Cl.
CPC ..... *E03C 1/284* (2013.01); *E03C 1/29* (2013.01)

(58) Field of Classification Search
CPC ..... E03C 1/284; E03C 1/29
(Continued)

(56) References Cited

U.S. PATENT DOCUMENTS 427,546 A * 5/1890 Bowerman ..... E03C 1/284 137/247.13
784,849 A * 3/1905 Fuqua ..... E03C 1/284 137/247.13

(Continued)

FOREIGN PATENT DOCUMENTS

CN 202031147 U 11/2011
CN 102414375 A 4/2012

(Continued)

OTHER PUBLICATIONS

International Search Report for PCT/EP2017/079294 dated Mar. 7, 2018 [PCT/ISA/210].

*Primary Examiner* — Angelisa L. Hicks
(74) *Attorney, Agent, or Firm* — Sughrue Mion, PLLC

(57) ABSTRACT

The invention relates to a siphon arrangement (1) comprising a housing (2) with an inlet connection piece (3), an outlet connection piece (4), and a siphon seat (5) arranged between the inlet connection piece (3) and outlet connection piece (4), and a siphon element (6) arranged in the siphon seat (5), said siphon element having a siphon portion (7) and an inlet (8) facing towards the inlet connection piece (3) and an outlet (9) leading to the outlet connection piece (4). Water can be guided from the inlet connection piece (3) via the inlet (8) into the siphon portion (7) and from the outlet (9) to the outlet connection piece (4). The siphon element (6) is movable, in particular pivotable, in the housing (2) from a use position into a maintenance position, and when in the maintenance position can be removed, in particular pulled out, from the housing.

17 Claims, 6 Drawing Sheets

(58) Field of Classification Search
USPC ..... 137/247.41
See application file for complete search history.

(56) References Cited

U.S. PATENT DOCUMENTS

| | | | | | |
|---|---|---|---|---|---|
| 919,701 | A | | 4/1909 | Donovan | |
| 1,176,806 | A | | 3/1916 | Wood et al. | |
| 1,284,165 | A | * | 11/1918 | Weimerskirch | E03C 1/284 137/247.41 |
| 3,346,887 | A | | 10/1967 | Sommer | |
| 4,523,740 | A | * | 6/1985 | Paitchell | F16K 27/067 251/315.05 |
| 2011/0115215 | A1 | * | 5/2011 | Cronje | E03C 1/284 285/129.1 |
| 2015/0129788 | A1 | * | 5/2015 | Hansen, III | F16K 5/12 251/148 |

FOREIGN PATENT DOCUMENTS

| | | | | | |
|---|---|---|---|---|---|
| CN | 103148296 | A | | 6/2013 | |
| CN | 204356864 | U | | 5/2015 | |
| CN | 205062937 | U | | 3/2016 | |
| DE | 37 25 076 | A1 | | 2/1989 | |
| DE | 203 02 386 | U1 | | 7/2004 | |
| DE | 20 2009 004 764 | U1 | | 10/2010 | |
| DE | 202016006857 | U1 | * | 11/2016 | E03C 1/284 |
| EP | 1 335 076 | A1 | | 8/2003 | |
| EP | 1 447 486 | A2 | | 8/2004 | |
| EP | 2 256 261 | A3 | | 2/2014 | |

* cited by examiner

SIPHON

CROSS REFERENCE TO RELATED APPLICATIONS

This application is a National Stage of International Application No. PCT/EP2017/079294 filed Nov. 15, 2017, claiming priority based on European Patent Application No. 17167952.5 filed Apr. 25, 2017.

TECHNICAL FIELD

The present invention relates to a siphon.

BACKGROUND OF THE INVENTION

Siphons as odor traps are known from the prior art. EP 1 447 486, for example, has disclosed a siphon which can be mounted, in particular, underneath a washbasin or a sink. The disadvantage with the siphon according to EP 1 447 486 is that, when cleaning the siphon, the housing part must be removed and the water in the siphon can escape from the housing in an uncontrolled way. Thus, the siphon cannot be cleaned without using a collecting basin.

EP 2 256 261 discloses a siphon which has the same disadvantages as that mentioned above.

DE 37 25 076 has disclosed another siphon. Rotary siphons of this kind have the disadvantage that the flow rate values are very negative.

The designs of said siphons all have the disadvantage that the siphons as such are of very complex construction. This not only makes production expensive but, especially in connection with assembly, often leads to problems with leak-tightness.

BRIEF SUMMARY OF THE INVENTION

Proceeding from this prior art, it is an underlying object of the invention to indicate a siphon which overcomes the disadvantages of the abovementioned prior art. In particular, it is an object to indicate a siphon element which is as easy as possible to clean and has good flow rate values.

This object is achieved by a siphon arrangement according to claim 1. According to this, a siphon arrangement comprises a housing with an inlet connection piece, an outlet connection piece, and a siphon seat arranged between the inlet connection piece and the outlet connection piece, and a siphon element arranged in the siphon seat, said siphon element having a siphon portion and an inlet facing toward the inlet connection piece and an outlet leading to the outlet connection piece. Water can be guided from the inlet connection piece via the inlet into the siphon portion and from the outlet to the outlet connection piece. An outlet line of a sanitary fitting, such as for example a washbasin or a sink, can be connected to the inlet connection piece, and a wastewater line can be connected to the outlet connection piece. The siphon element is mounted in the housing in such a way as to be movable, in particular pivotable, from a use position to a maintenance position, and, when in the maintenance position, can be removed, in particular pulled out, from the housing via an access opening. The siphon element has the form of a bent tube.

The design of the siphon element as a siphon element that can be removed from the housing and as a tubular siphon results in the advantage that the siphon element is easy to clean and has good flow rate values.

Furthermore, the design of the siphon as a bent tube makes it possible to create a particularly simple structure. Moreover, this design has the advantage that complex seals are no longer necessary.

A "bent tube" is taken to mean a tube which is bent in such a way that it forms an odor trap. The bent tube is bent in a U shape, for example. The "bent tube" can also be referred to as a bent tube siphon, bent tube odor trap or tubular siphon.

The siphon element is preferably designed in such a way that, when the siphon element moves, at least some of the water in the siphon portion flows to the outlet connection piece and that any residual water in the siphon portion cannot flow out of the siphon portion during removal of the siphon element. With this preferred variant, an uncontrolled egress of water in the case of cleaning can be largely avoided. That is to say that the described design of the siphon element results in the advantage that the water in the siphon portion can flow out of the siphon portion in a controlled manner at least in part or in whole via the outlet connection piece. This prevents the water from escaping in an uncontrolled manner during maintenance work, something that will typically lead to water damage or a larger amount of cleaning work.

The design of the siphon element as a bent tube has the advantage that the siphon can act as a kind of vessel. That is to say that residual water present in the siphon cannot flow out of the siphon portion when the siphon element is removed.

Moreover, the design of the siphon element as a bent tube has the advantage that standing water is only ever present in the bent tube, which is advantageous for the stressing of the seals in comparison with seals that are to be installed in the prior art.

As a particular preference, the siphon element can be pivoted through an angle of at most 120°. Depending on the design of the siphon element, the angle can also be less than 120°, which has the advantage that not all the elements situated in the siphon portion, e.g. a decorative piece, are emptied during the movement of the siphon element out of the siphon portion.

The outlet is preferably moved against the outlet connection piece during the movement into the maintenance position, in which case the outlet is then lower than the inlet. The water lying in the siphon portion can then escape in whole or at least in part from the siphon element through the outlet and flows off via the outlet connection piece.

The siphon arrangement furthermore preferably has a mounting element, which can be connected to the housing, wherein the siphon element is mounted on the mounting element in such a way as to be movable within a predetermined play. The mounting element and the siphon element are preferably two elements that are formed discretely or separately from one another and which are connected mechanically to one another. Here, the mechanical connection is such that the two parts can be pivoted together relative to the fixed housing.

The siphon arrangement is preferably connected to the mounting element by means of a longitudinal guide, wherein the mobility between the siphon element and the mounting element within the predetermined play is limited substantially to the longitudinal movement along the longitudinal guide.

That is to say that the siphon element can move along the longitudinal guide relative to the mounting element. The mobility has the advantage that the siphon element can be moved into the correct position during the movement between the assembly position and the use position, thus ensuring that the siphon element comes to lie accurately in the use position.

The play is limited by corresponding mechanical stops, wherein the siphon element can move relative to the mounting element within this play.

The siphon element is preferably connected to the mounting element by means of a latching connection. Here, the latching connection can be part of said longitudinal guide or can be formed separately from said longitudinal guide. In this arrangement, the latching connection allows play in the same direction as the longitudinal guide.

As a particular preference, the latching connection are latching tabs which project from the mounting element and engage in a latching opening in the siphon element. The longitudinal guide is a guide peg which projects from the mounting element and engages in a guide aperture in the siphon element.

The guide peg is preferably collinear with the pivoting axis.

A seat, in particular a bayonet joint, for the mounting element is preferably arranged in the region of the access opening. The mounting element can be locked to the housing by means of the seat in the use position. That is to say that the mounting element is connected firmly to the housing in the use position.

The bayonet joint is preferably designed in such a way that the siphon element can be inserted into the housing only in the correct position.

The mounting element is preferably a lid which closes the siphon seat. The siphon element is then arranged on the inside of the cover, which faces the siphon seat. On the outside of the lid, the lid comprises elements which can be grasped by the user.

In the use position, the lid preferably extends completely over the access opening and accordingly closes the latter.

The lid and the access opening are preferably of substantially circular design, wherein the lid can be inserted into the access opening and can be pivoted there in an appropriate manner. Owing to the connection between the lid and the siphon element, this pivoting also leads to the pivoting of the siphon element between the maintenance position and the use position.

A seal is preferably provided between the mounting element and the housing. By means of the seal, the connection between the mounting element and the housing can be closed in a leak-tight manner in relation to water, thus ensuring that no water can escape from the housing.

In the embodiment with the circular lid and the circular access opening, the seal is preferably a sealing ring.

The mounting element or the lid, respectively, preferably has an actuating element that is accessible from the outside of the housing. The actuating element is preferably designed in such a way that it can be grasped easily by hand without the aid of a tool.

At least one guide structure is preferably arranged between the siphon seat and the siphon element. The guide structure is designed in such a way that the siphon element is pressed against the inlet connection piece during the rotation from the maintenance position to the use position. That is to say that, within the scope of its mobility, particularly relative to the mounting element, the siphon element is moved in the siphon seat against the inlet connection piece by the guide structure, with the result that, in the use position, the siphon element is moved and pressed against the inlet connection piece, in particular against the entry point of the inlet connection piece into the siphon seat. This movement and contact pressure has the advantage of ensuring that the siphon element is well-positioned against the inlet connection piece, which is advantageous for sealing.

The guide structure can have smooth or level guide surfaces or patterned guide surfaces, respectively.

As a particular preference, the guide structure has a guide surface and a guide peg which strikes against the latter. The guide surface is arranged in a fixed manner in the siphon seat, wherein the guide peg is arranged in a fixed manner on the siphon element and comes into contact with the guide surface and slides along the guide surface in the direction of the inlet connection piece during the movement into the use position. The siphon element is thereby likewise guided in the direction of the inlet connection piece and pressed against the inlet connection piece.

A respective guide structure is preferably arranged on each side of the tube of the siphon element. This means, in particular, that a respective pair consisting of guide peg and guide surface is situated on each side of the tube. This design has the advantage that jamming of the movement of the siphon element between the maintenance position and the use position cannot occur.

The guide surface preferably slopes at an angle to the line of movement of the guide peg from the maintenance position to the use position, wherein the guide surface is oriented substantially in the same direction as said longitudinal guide when the siphon element is in the use position.

The guide peg preferably strikes the guide surface shortly before the use position is reached. If the siphon element is pivoted through an angle of 120°, for example, during the movement from the maintenance position to the use position, the contact between the guide peg and the guide surface is established after a pivoting movement of at least 80°, i.e. the contact then continues over a pivoting angle of 10°.

A seal, against which the inlet of the siphon element rests in a leak-tight manner, is preferably arranged in the entry region of the inlet connection piece into the siphon seat, wherein the siphon element is pressed against the seal in the use position.

As regards the guide structure, this means that, with the aid of this guide structure, the siphon element is pressed against the seal, wherein it is possible to achieve secure contact between the inlet of the siphon element and the seal.

Shortly before or in the use position, respectively, the sealing surface of the seal is preferably substantially at right angles to the movement of the siphon element provided by the guide structure. Shortly before or in the use position, respectively, the sealing surface of the seal is preferably substantially at right angles to the longitudinal movement along the longitudinal guide. This has the advantage that the inlet of the siphon element meets the seal substantially at right angles, minimizing the wear on the seal and extending the life thereof.

The sealing surface is preferably designed to slope at an angle to the center line of the inlet connection piece and thus slopes at an angle to the vertical in the installed position of the siphon arrangement. This has the advantage that the siphon seat can be of more compact design because less installation space has to be provided for said movement of the siphon element at right angles toward the sealing surface.

The cross section of the tube is preferably oval or elliptical or circular. The cross section of the inlet connection piece is preferably circular, wherein the cross section can be adapted to the tube by means of the seal. The cross section of the tube is preferably substantially constant over the entire tube length.

Apart from the inlet and from the outlet, a wall preferably surrounds the tube substantially completely. In other words, the tube is designed as a passage which is peripherally enclosed.

In the use position, the inlet is preferably essentially higher or on the same level as the outlet. In this arrangement, the siphon element extends downward in the direction of gravity, when viewed from the inlet, and then back up as far as the outlet.

In the use position, the inlet of the siphon element is directly below the inlet connection piece, thus allowing the entire quantity of water to be fed to the siphon.

While the inlet is being moved, preferably toward the inlet connection piece or under the inlet connection piece, respectively, as described above, the outlet is free in the siphon seat. The water passed through the siphon element will leave the siphon element via the outlet and flows into the siphon seat, whereupon it is fed to the outlet connection piece. The entry region leading from the siphon seat into the outlet connection piece is preferably arranged in the base of a retention recess. The retention recess is designed in such a way that, in the installed position, the lowermost edge region of the access opening is at a distance above the retention recess.

The siphon arrangement preferably has a retention space, which is designed in such a way that an object, such as an object of value, situated in the tube of the siphon element can fall into the retention space during a rotation from the use position to the maintenance position.

As a particular preference, the retention space is integrated into the siphon element and extends outward from the siphon wall in the region of the outlet and/or of the inlet, wherein the retention space is designed in such a way that an object, such as an object of value, situated in the tube can fall into the retention space during a rotation from the use position to the maintenance position. Consequently, the user can remove the object from the retention space after removing the siphon element from the siphon seat. This prevents the object falling out of the siphon element in the direction of the outlet connection piece during the movement from the use position to the maintenance position.

Alternatively, it is also possible for the retention space to be arranged in the siphon seat.

The outlet connection piece is preferably arranged in such a way relative to the inlet connection piece that water flows into the outlet connection piece from the inlet connection piece when the siphon element is not inserted. This is advantageous if water enters the siphon arrangement via the inlet when the siphon element is not inserted. This water will then flow through the siphon arrangement and leave it through the outlet connection piece, thus making it possible to largely prevent water damage.

When viewed in the installed position, the inlet from the siphon seat into the outlet connection piece is preferably lower than the access opening.

Further embodiments are indicated in the dependent claims.

BRIEF DESCRIPTION OF THE DRAWINGS

Preferred embodiments of the invention are described below with reference to the drawings, which serve only for explanation and should not be interpreted as restrictive. In the drawings.

DESCRIPTION OF THE INVENTION

Figure 6:
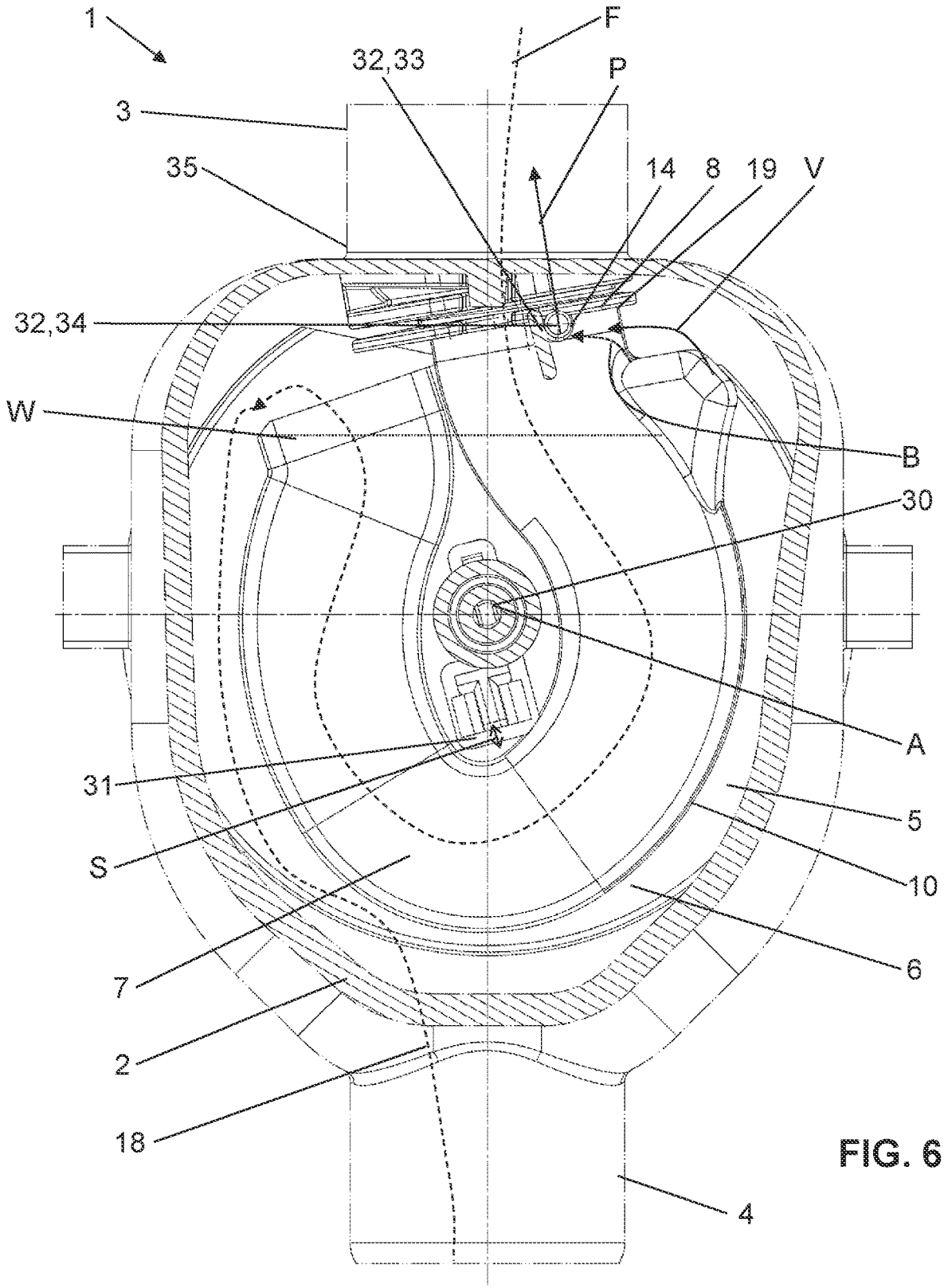
FIG. 6 shows a sectional illustration of the siphon arrangement shown in FIG. 1, wherein the siphon element is shown at a third position.

In the figures, a siphon arrangement 1 in accordance with one embodiment of the present invention is shown. The siphon arrangement 1 comprises a housing 2 with an inlet connection piece 3, an outlet connection piece 4, and a siphon seat 5 arranged between the inlet connection piece 3 and the outlet connection piece 4. The siphon arrangement 1 furthermore comprises a siphon element 6 arranged or mounted in the siphon seat 5, respectively, said siphon element having a siphon portion 7 and an inlet 8 facing toward the inlet connection piece 3 and an outlet 9 leading to the outlet connection piece 4. The siphon portion 7 acts as an odor trap. Water is guided from the inlet connection piece 3 via the inlet 8 into the siphon portion 7 and then passes through the siphon portion 7 and can then be carried out of the siphon portion 7 to the outlet connection piece 4 via the outlet 9. The water flows through the siphon portion 7. In FIG. 6, the direction of flow of the water has been indicated by a dashed line F.

Figure 4:
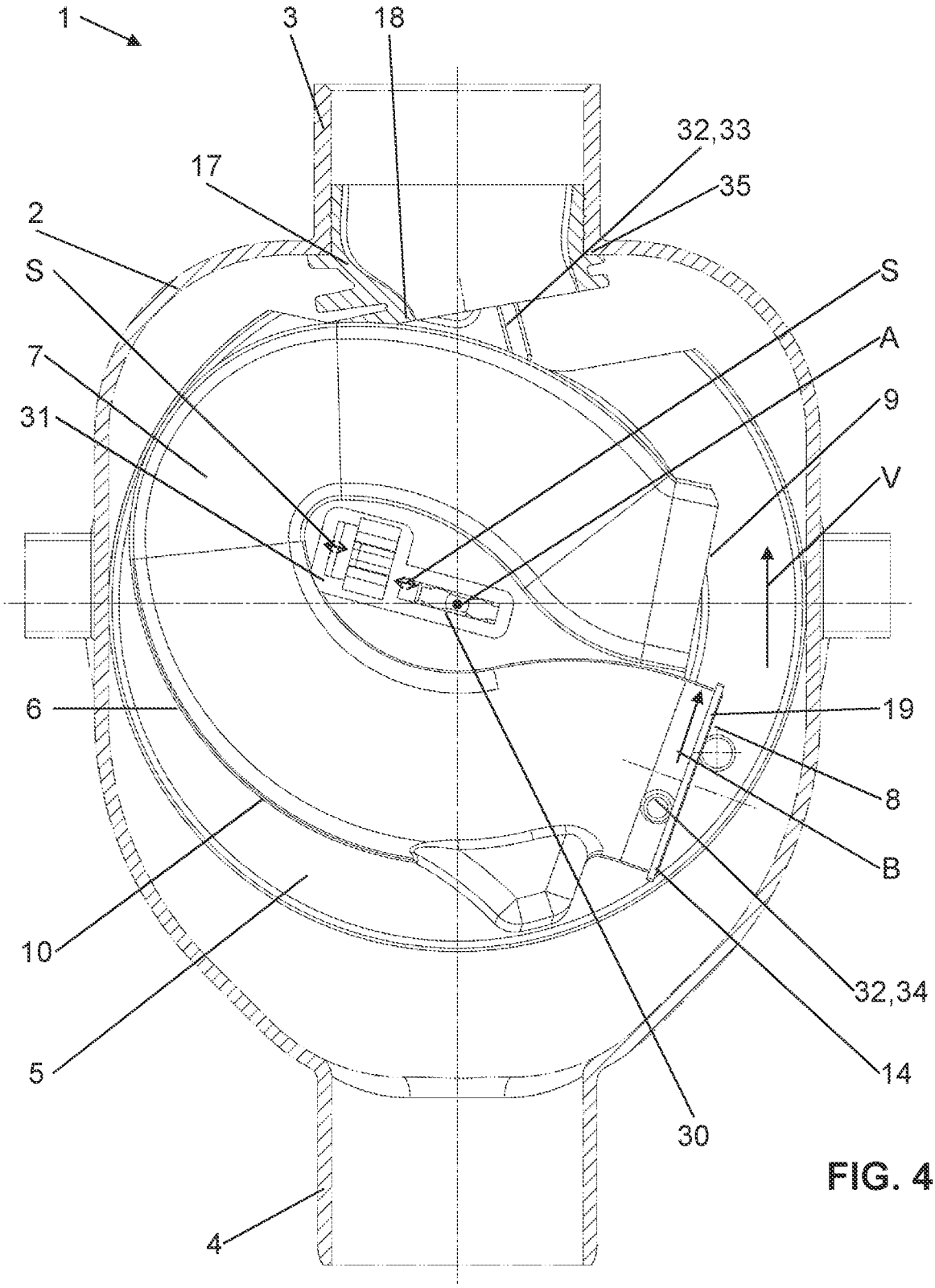
FIG. 4 shows a sectional illustration of the siphon arrangement shown in FIG. 1, wherein the siphon element is shown at a first position.

The siphon element 6 is mounted in the siphon seat 5 in the housing 2 in such a way as to be movable from a maintenance position, as shown in FIG. 4, to a use position, as shown in FIG. 6. In the embodiment shown, the siphon element 6 can be pivoted about a pivoting axis A. The pivoting angle can be up to 120°. From the maintenance position, the siphon element 6 can be removed from the housing 2. In the embodiment shown, it is pulled out of the siphon seat 5 along the pivoting axis A.

Figure 1:
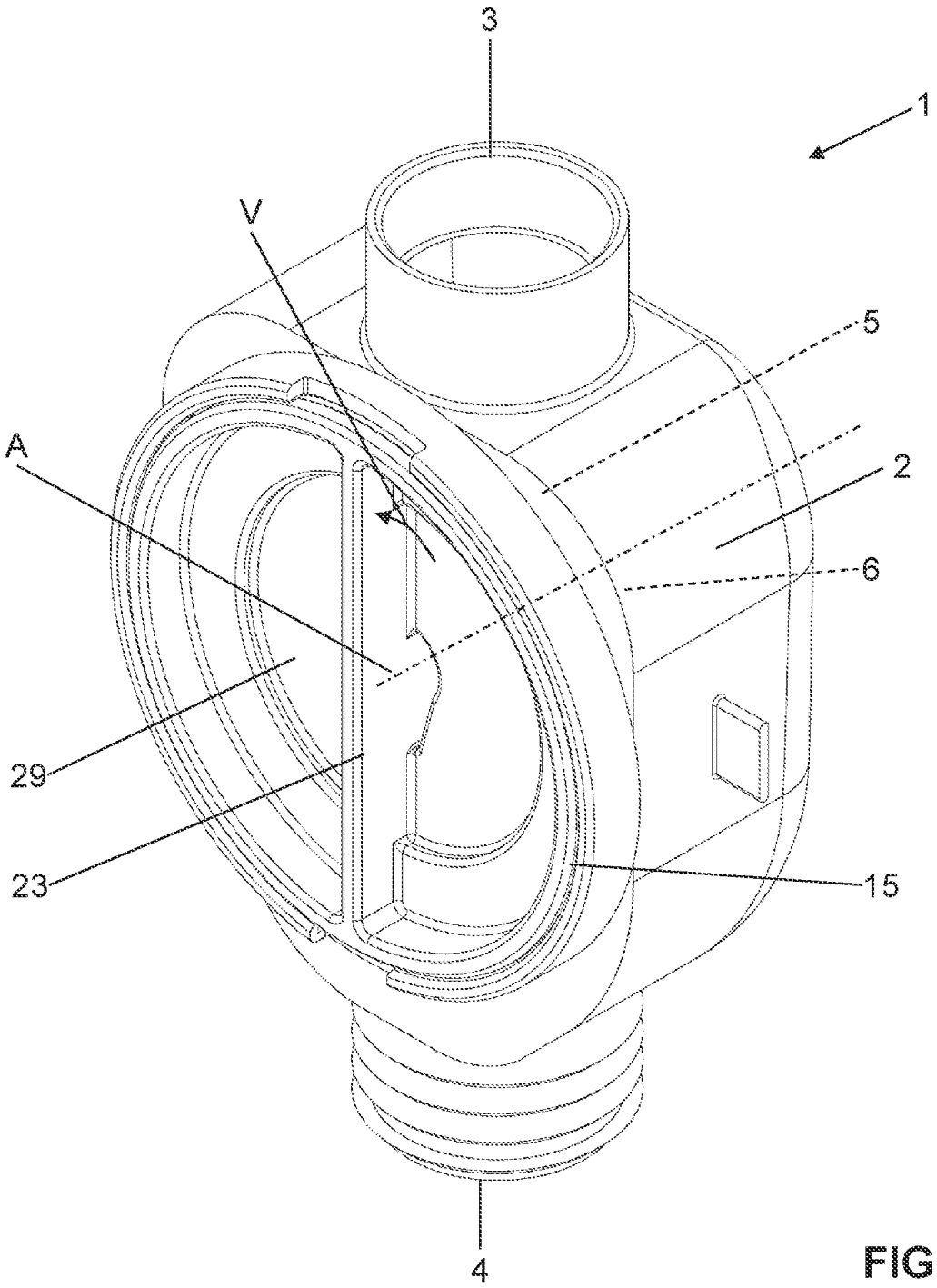
FIG. 1 shows a perspective view of a siphon arrangement having a siphon element in accordance with one embodiment of the present invention.
Figure 2:
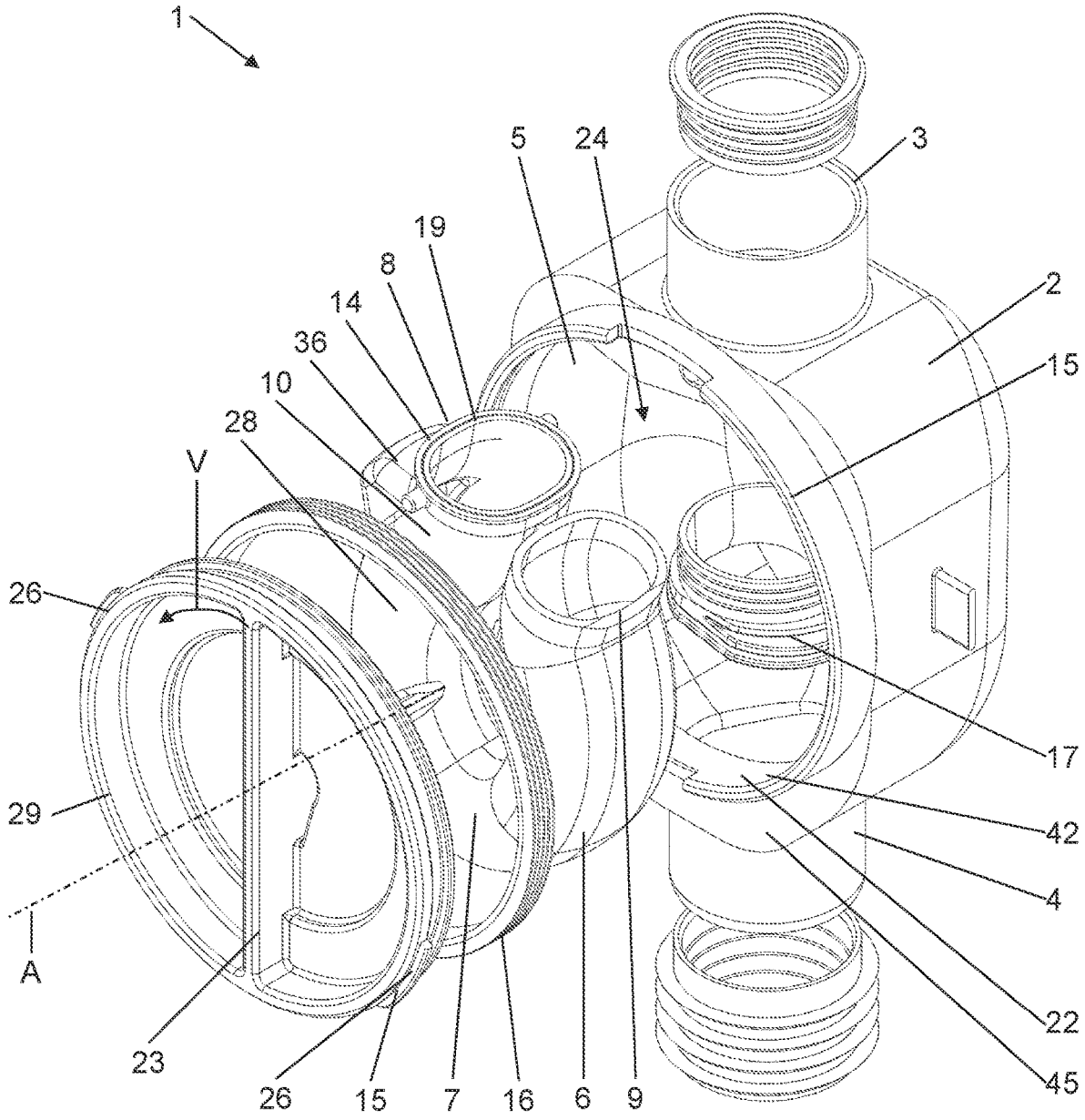
FIG. 2 shows an exploded perspective view of the siphon arrangement shown in FIG. 1.

In FIG. 2, an exploded illustration of the siphon arrangement 1 is shown. The siphon element 6 has the form of a bent tube 28. Here, the tube 28 extends from the inlet 8 to the outlet 9. The tube 28 is of fundamentally U-shaped design, wherein the tube 28 extends slightly outward laterally before and after the actual siphon portion 7, giving rise to a kind of bulbous U shape.

The siphon arrangement 1 furthermore comprises a mounting element 29. In FIG. 2, the mounting element 29 is likewise illustrated at a distance from the housing 2. The mounting element 29 can be connected to the housing 2. The siphon element 6 is mounted on the mounting element 29 in such a way as to be movable within a predetermined play S.

Figure 3:
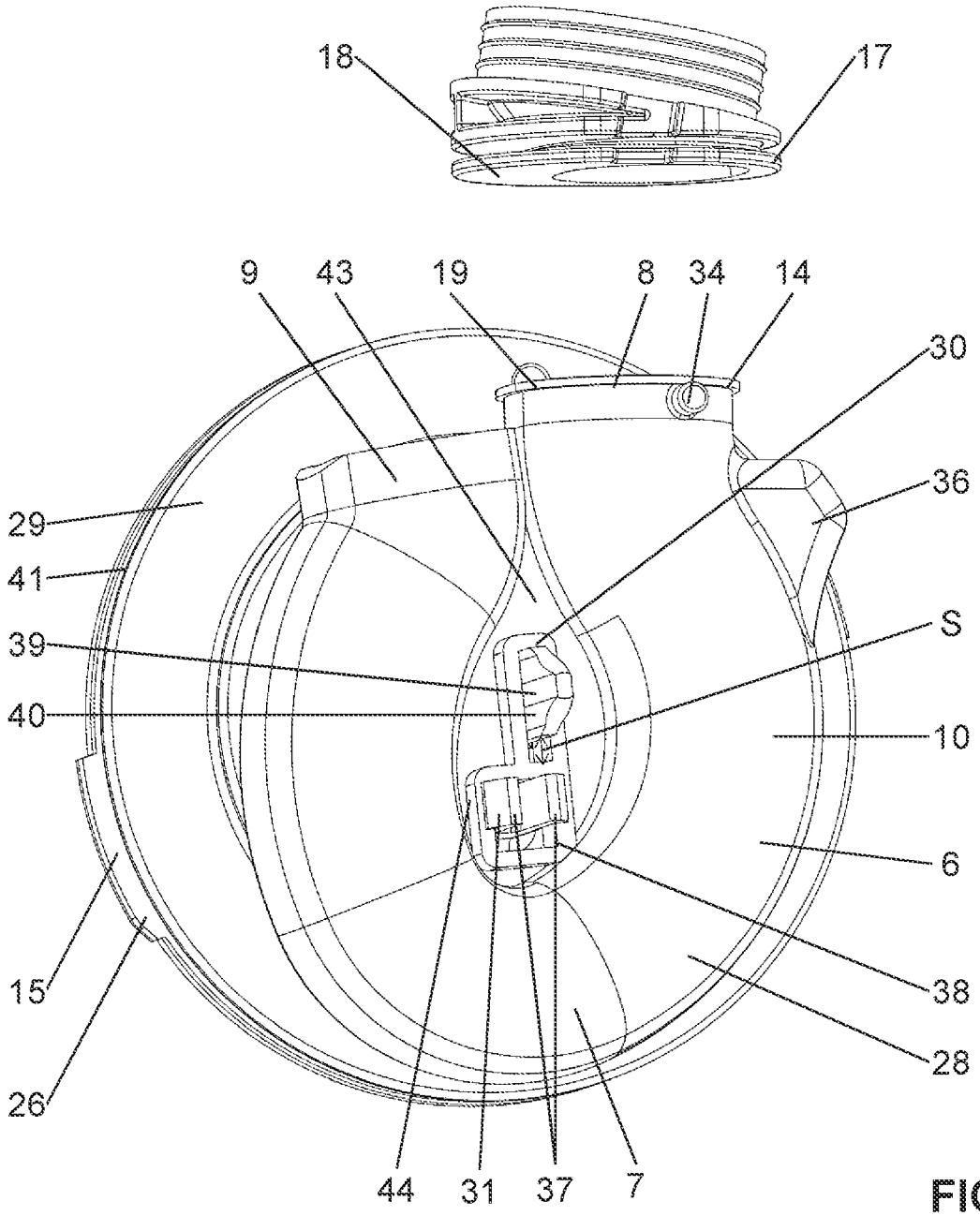
FIG. 3 shows a detail view of the siphon element.

The combination of the mounting element 29 and the siphon element 6 is shown in more detail in FIG. 3. Here, the siphon element 6 is connected to the mounting element 29 by means of a longitudinal guide 30. The mobility between the siphon element 6 and the mounting element 29 within the predetermined play S is limited substantially to the longitudinal movement along the longitudinal guide 30. This means therefore that the siphon element 6 can move along the longitudinal guide 30 within the scope of the play S.

In the embodiment shown, the siphon element 6 is connected to the mounting element 29 by means of a latching connection 31. Here, the latching connection 31 is formed separately from said longitudinal guide 30. The latching connection 31 comprises latching tabs 37, which protrude from the mounting element 29 and engage in latching openings 38 in the siphon element 6. That is to say that the siphon element 6 can enter into a latching connection with the mounting element 29 via the latching opening 38 by means of the latching tabs 37.

The longitudinal guide in the embodiment shown is a guide peg 39 which likewise protrudes from the mounting element 29 and projects into a guide aperture in the siphon element 6. Here, the guide aperture 40 extends in the form of a slot in the direction in which longitudinal mobility is desired. In the embodiment shown, the geometrical design of the guide peg 39 and of the guide aperture 40 defines the play S.

In the embodiment shown, the guide aperture 40 and the latching opening 38 are arranged in a wall 43, which is situated in the interspace formed by the two tube sections of the tube 28. Reinforcing ribs 44 are arranged around the guide aperture 40 and around the latching opening 38.

The latching connection 31 between the mounting element 29 and the siphon element 6 likewise has a play, which allows said movement along the longitudinal guide 30.

In alternative embodiments, which are not shown here, it is also possible for the latching connection 31 to be an integral part of the longitudinal guide 30.

FIGS. 2 and 3 show that a seat 22 is arranged in the region of the access opening 24 into the siphon seat 5. The seat 22 serves to accommodate the mounting element 29, wherein the mounting element 29 can be locked to the housing 2 by means of the seat in the use position. In the embodiment shown, the seat 22 and the mounting element 29 are designed as a bayonet joint. That is to say that the mounting element 29 can be inserted into the seat 22 and is then pivoted relative to the fixed seat 22.

In the embodiment shown, the mounting element 22 is a lid which closes the siphon seat 5 in the region of the access opening 24. The cover 29 extends completely over said access opening 24. Here, a seal 16 is provided between the mounting element 29 and the housing 2. By means of the seal 16, the siphon seat 5 can be sealed off with respect to the outside. The seal 16 is a circular ring seal, which is preferably mounted on a shoulder 41 on the mounting element 29 and is pressed against an inner wall 42 in the region of the access opening 24.

A further seal is arranged in the entry region 35 of the inlet connection piece 3 into the siphon seat. This seal is shown in FIG. 3 and bears the reference numeral 17. The interaction of this seal with the inlet 8 of the siphon element is explained in greater detail in connection with FIGS. 4 to 6. The inlet 8 of the siphon element 6 rests leak-tightly against this seal 17, wherein the siphon element 6 is pressed against the seal 17 in the use position.

In the embodiment shown, the cross section of the tube 28 of the siphon element is of oval or elliptical design, respectively. The cross section of the tube 28 is substantially constant over the entire tube length. The tube 28 is surrounded by a siphon wall 10. It is also possible for the cross section of the tube 28 to be circular. In the embodiment shown, an oval structure has been chosen because this is advantageous for the space conditions and the compactness of the siphon element 6.

In the sectional illustration in FIG. 4, the siphon element is shown in the maintenance position. The siphon element 6 is then pivoted out of this maintenance position into the use position along the arrow V.

Figure 5:
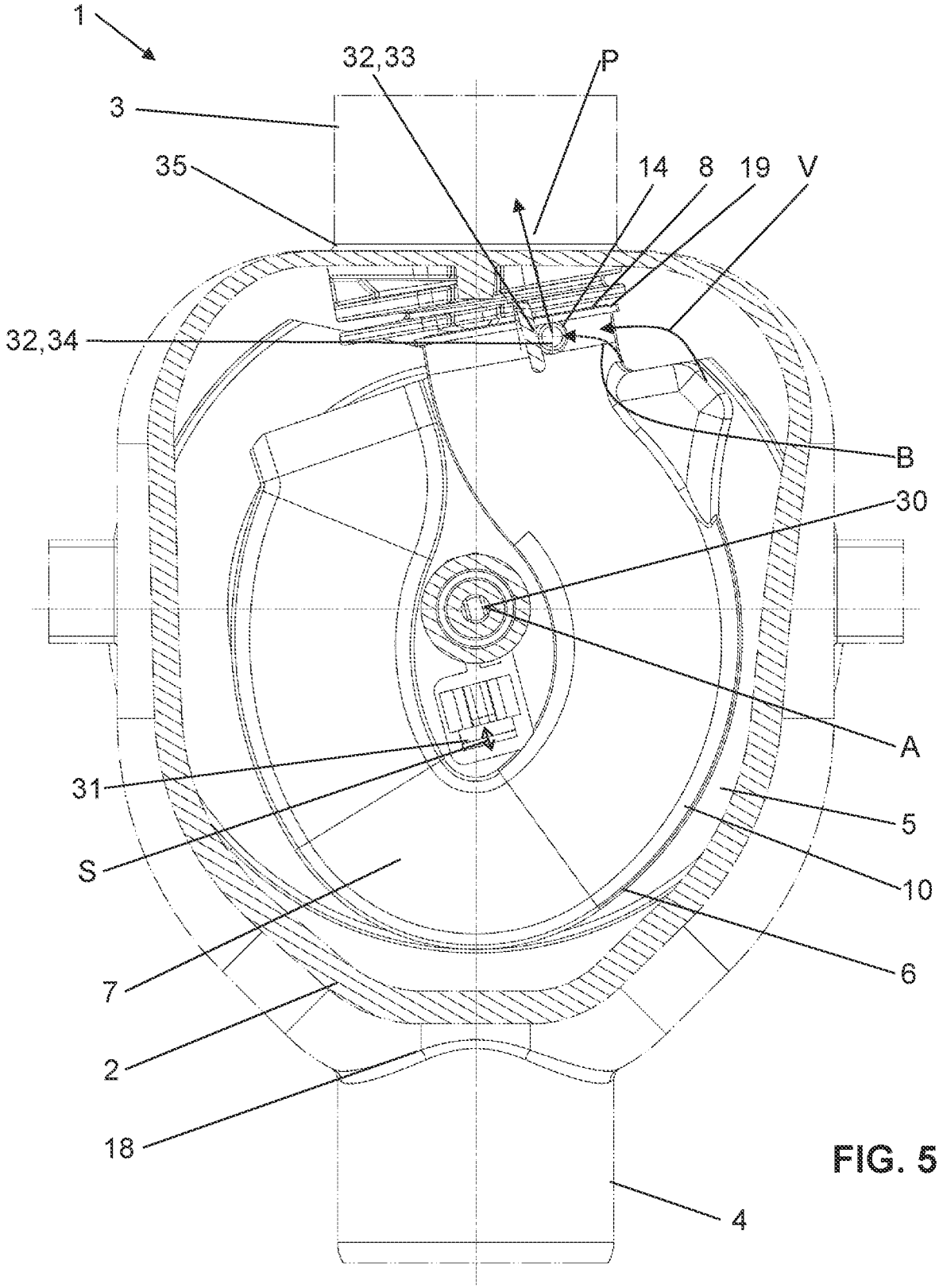
FIG. 5 shows a sectional illustration of the siphon arrangement shown in FIG. 1, wherein the siphon element is shown at a second position.

In FIG. 5, the siphon element 6 is just before the adoption of the use position. A guide structure 32 is arranged between the siphon seat 5 and the siphon element 6. In the embodiment shown, the guide structure 32 is situated in the region of the inlet connection piece 3 or of the inlet 8 into the siphon element 6, respectively. The guide structure 32 is designed in such a way that the siphon element 6 is pressed against the inlet connection piece 3, i.e. in the direction of the inlet connection piece 3, during the rotation from the maintenance position to the use position. That is to say that the guide structure 32 can be used to provide a movement of the siphon element 6 toward the inlet connection piece 3 in the direction of the arrow P. Here, the movement in the direction of the arrow P is oriented substantially in the direction of the longitudinal guide 30. That is to say that the siphon element 6 is pressed against the inlet connection piece 3 in the direction of the longitudinal guide 30. In the embodiment shown, the seal 17 is arranged in the entry region 35 of the inlet connection piece 3 into the siphon seat 5.

The seal 17 comprises a sealing surface 18. By means of the guide structure 32, the siphon element 6 is then pressed against the sealing surface. Here, the sealing surface 18 is oriented substantially at right angles to the longitudinal guide 30 when the siphon element 6 is in the use position. That is to say that the siphon element 6 is pressed onto the sealing surface 18 substantially at right angles. Here, the inlet 8 of the tube 28 is surrounded by an end face 19, and the end face 19 is pressed against the sealing surface 18.

In the embodiment shown, the guide structure 32 has a guide surface 33 and a guide peg 34 which strikes against the latter. The guide surface 33 is connected in a fixed manner to the siphon seat 5, and the guide peg 34 is arranged in a fixed manner on the siphon element 6. During the movement into the use position, the guide peg 34 then comes into contact with the guide surface 33 and slides along the guide surface 33 in the direction of the inlet connection piece 3 or in the direction of the seal 17, respectively. The siphon element 6 is thereby also pushed in the direction of the inlet connection piece 3.

The guide surface 33 slopes at an angle to the line of movement B of the guide peg from the maintenance position to the use position. Here, the guide surface 33 is oriented substantially in the same direction into said longitudinal guide 30 when the siphon element 6 is in or shortly before the use position. The impingement of the guide peg 34 on the guide surface 33 is shown in FIG. 5. During further pivoting, the siphon element 6 will slide within the play S of the longitudinal guide 30 along the guide surface 33 in the direction of the inlet connection piece 3 and then occupies the position shown in FIG. 6. The position shown in FIG. 6 corresponds to the use position, in which water can flow into the siphon element 6 from the inlet connection piece 3. In the use position, the inlet 8 of the siphon element 6 is pressed against the sealing surface 19.

Comparison of the position of the siphon element 6 as between that in FIG. 5 and that in FIG. 6 shows clearly that the play S in the region of the longitudinal guide 30 or of the latching connection 31, respectively, has been fully exploited. That is to say that the siphon element is moved within the play S from the lower position shown in FIG. 5 to the upper position shown in FIG. 6.

In all the figures, it can readily be seen that a retention space 36 extends outward on the siphon wall 10 in the region of the inlet 8. This retention space 36 is advantageous during the movement of the siphon element 6 into the maintenance position, as shown in FIG. 4. An object, e.g. an object of value, situated in the lowermost region of the siphon element 6 can fall into the retention space 36 during the rotation of the siphon element from the use position to the maintenance position. That is to say that the object is retained in the retention space 36 and is not emptied out via the inlet 8. It is thus possible to prevent the object from moving in the direction of the outlet connection piece 4 and thus in the direction of the wastewater system.

It is readily apparent from FIG. 2 how the water is guided from the inlet connection piece 3 via the inlet 8 into the siphon portion 7 and can then flow from the outlet 9 to the outlet connection piece 4. The inlet into the outlet connection piece 4 is lower than the seat 22 or the access opening 24, respectively. This makes it possible to prevent water flowing out of the siphon portion 7 through the access opening 24 after the rotary movement. In the embodiment shown, a skirt 45 extends downward from the access opening 24, wherein said inlet is then situated at the lower end of the skirt 45.

FIGS. 4 to 6 show that the siphon element 6 is designed in such a way that, during a movement of the siphon element 6, at least some of the water lying in the siphon portion 7 flows to the outlet connection piece 4. In FIG. 6, the water lying in the siphon portion 7 is symbolized by a dashed line W. In FIG. 5, the siphon element 6 is shown in the use position. Here, the siphon portion 7 is filled with water up to the line W, which runs through the inlet 8 and the outlet 9. If the siphon element 6 is then pivoted from the use position to the maintenance position, the water lying in the siphon portion 7 can flow off in the direction of the outlet connection piece 4 via the outlet 9. This is symbolized in FIG. 4 by the arrow V. The water thus flows over the edge with the reference sign 14, which delimits the outlet 9, in the direction of the outlet connection piece 4.

The siphon element 6 is furthermore designed in such a way that any residual water in the siphon portion 7 cannot flow out of the siphon portion 7 during removal of the siphon element 6. That is to say that the siphon portion 7 is designed as a kind of "cup", wherein the water then remains in this "cup". In the embodiment shown, the siphon portion 7 is delimited by a wall 10. The wall 10 surrounds the siphon portion 7 substantially completely, apart from the inlet 8 and the outlet 9. Thus, by virtue of the wall 10, the siphon portion 7 is formed as a peripherally enclosed passage, whereby the "cup" just mentioned can be provided.

Further features of the embodiment under consideration will now be explained in greater detail with reference to FIG. 3.

In the use position, the inlet 8 of the siphon portion 7 is slightly higher than the outlet 9. During the movement from the use position to the maintenance position, the outlet 9 can be moved toward the outlet connection piece 4, wherein the outlet 9 then comes to lie lower than the inlet 8.

The siphon element 6 is mounted in the access opening 24 by means of a bayonet joint 15. Here, the bayonet joint 2 is arranged in such a way that it lies outside the water-carrying parts. In the embodiment shown, the bayonet joint 15 has two clamping lugs 26. Here, one of the two clamping lugs is of different design from the other of the two clamping lugs, thus ensuring that the siphon element 6 can be inserted into the housing 2 only in the correct position.

The siphon element 6 furthermore has an actuating element 23 that is accessible from the outside of the housing 2. Here, therefore, the actuating element 23 is designed as a web which can be grasped easily by a user.

| LIST OF REFERENCE SIGNS | |
|---|---|
| 1 | siphon arrangement |
| 2 | housing |
| 3 | inlet connection piece |
| 4 | outlet connection piece |
| 5 | siphon seat |
| 6 | siphon element |
| 7 | siphon portion |
| 8 | inlet |
| 9 | outlet |
| 10 | siphon wall |
| 14 | edge |
| 15 | bayonet joint |
| 16 | seal |
| 17 | seal |
| 18 | sealing surface |
| 19 | end face |
| 22 | seat |
| 23 | actuating element |
| 24 | access opening |
| 26 | clamping lugs |
| 28 | tube |
| 29 | mounting element |
| 30 | longitudinal guide |
| 31 | latching connection |
| 32 | guide structure |
| 33 | guide surface |
| 34 | guide peg |
| 35 | entry region |
| 36 | retention space |
| 37 | latching tabs |
| 38 | latching openings |
| 39 | guide peg |
| 40 | guide aperture |
| 41 | shoulder |
| 42 | inner wall |
| 43 | wall |
| 44 | reinforcing rib |
| 45 | skirt |
| A | pivoting axis |
| B | direction of movement |
| W | water level |
| V | arrow |
| S | pivoting axis |
| P | arrow |
| F | direction of flow |

The invention claimed is:

1. A siphon arrangement comprising a housing with an inlet connection piece, an outlet connection piece, and a siphon seat arranged between the inlet connection piece and the outlet connection piece, and a siphon element arranged in the siphon seat, said siphon element having a siphon portion and an inlet facing toward the inlet connection piece and an outlet opening into the siphon seat, wherein water can be guided from the inlet connection piece via the inlet into the siphon portion and from the outlet into the siphon seat and then to the outlet connection piece, wherein the siphon element is mounted in the housing in such a way as to be movable from a use position to a maintenance position, and, when in the maintenance position, can be removed from the housing via an access opening, wherein the siphon element has the form of a bent tube, wherein the siphon arrangement furthermore has a mounting element, which can be connected to the housing, wherein the siphon element is mounted on the mounting element in such a way as to be movable within a play, wherein the siphon element is connected to the mounting element by means of a longitudinal guide, wherein said siphon element is pivotable, wherein the mobility between the siphon element and the mounting element within the play is limited substantially to a longitudinal movement along the longitudinal guide, and wherein the mounting element is a lid which closes the siphon seat in the region of the access opening.

2. The siphon arrangement as claimed in claim 1, wherein the siphon arrangement furthermore has a mounting element, which can be connected to the housing, wherein the siphon element is mounted on the mounting element in such a way as to be movable within a predetermined play.

3. The siphon arrangement as claimed in claim 2, wherein a seat or a bayonet joint for the mounting element is arranged in the region of the access opening, wherein the mounting element can be locked to the housing by means of the seat or the bayonet joint in the use position.

4. The siphon arrangement as claimed in claim 2, wherein a seal is provided between the mounting element and the housing.

5. The siphon arrangement as claimed in claim 1, wherein a seal, against which the inlet of the siphon element rests in a leak-tight manner, is arranged in an entry region of the inlet connection piece into the siphon seat, wherein the siphon element is pressed against the seal in the use position.

6. The siphon arrangement as claimed in claim 1, wherein a seal, against which the inlet of the siphon element rests in a leak-tight manner, is arranged in an entry region of the inlet connection piece into the siphon seat, wherein the siphon element is pressed against the seal in the use position and wherein, shortly before or in the use position, respectively, the sealing surface of the seal is substantially at right angles to the movement of the siphon element provided by the guide structure.

7. The siphon arrangement as claimed in claim 1, wherein a cross section of the tube is oval or elliptical or circular.

8. The siphon arrangement as claimed in claim 1, wherein when viewed in the installed position, the inlet from the siphon seat into the outlet connection piece is lower than the access opening.

9. The siphon arrangement as claimed in claim 1, wherein a cross section of the tube is substantially constant over the entire tube length.

10. The siphon arrangement as claimed in claim 1, wherein the tube is surrounded by a siphon wall.

11. A siphon arrangement comprising:

a housing with an inlet connection piece, an outlet connection piece, and a siphon seat arranged between the inlet connection piece and the outlet connection piece, and a siphon element arranged in the siphon seat, said siphon element having a siphon portion and an inlet facing toward the inlet connection piece and an outlet opening into the siphon seat, wherein water can be guided from the inlet connection piece via the inlet into the siphon portion and from the outlet into the siphon seat and then to the outlet connection piece, wherein the siphon element is mounted in the housing in such a way as to be movable from a use position to a maintenance position, and, when in the maintenance position, can be removed from the housing via an access opening, wherein the siphon element has the form of a bent tube, wherein the siphon element is connected to the mounting element by means of a longitudinal guide, wherein the siphon element is connected to the mounting element by means of a latching connection, wherein said siphon element is pivotable, and wherein the latching connection is part of said longitudinal guide or is formed separately from said longitudinal guide.

12. The siphon arrangement as claimed in claim 11, wherein a seal, against which the inlet of the siphon element rests in a leak-tight manner, is arranged in an entry region of the inlet connection piece into the siphon seat, wherein the siphon element is pressed against the seal in the use position and wherein, shortly before or in the use position, respectively, the sealing surface of the seal is substantially at right angles to the longitudinal movement along the longitudinal guide.

13. A siphon arrangement comprising:

a housing with an inlet connection piece, an outlet connection piece, and a siphon seat arranged between the inlet connection piece and the outlet connection piece, and a siphon element arranged in the siphon seat, said siphon element having a siphon portion and an inlet facing toward the inlet connection piece and an outlet opening into the siphon seat, wherein water can be guided from the inlet connection piece via the inlet into the siphon portion and from the outlet into the siphon seat and then to the outlet connection piece, wherein the siphon element is mounted in the housing in such a way as to be movable from a use position to a maintenance position, and, when in the maintenance position, can be removed, from the housing via an access opening, wherein the siphon element has the form of a bent tube, wherein at least one guide structure is arranged between the siphon seat and the siphon element, and wherein the at least one guide structure is designed in such a way that the siphon element is pressed against the inlet connection piece during the rotation from the maintenance position to the use position.

14. The siphon arrangement as claimed in claim 13, wherein the guide structure has a guide surface and a guide peg which strikes against the latter, wherein the guide surface is arranged in a fixed manner in the siphon seat and wherein the guide peg is arranged in a fixed manner on the siphon element and comes into contact with the guide surface and slides along the guide surface in the direction of the inlet connection piece during the movement into the use position.

15. The siphon arrangement as claimed in claim 13, wherein the guide structure has a guide surface and a guide peg which strikes against the latter, wherein the guide surface is arranged in a fixed manner in the siphon seat and wherein the guide peg is arranged in a fixed manner on the siphon element and comes into contact with the guide surface and slides along the guide surface in the direction of the inlet connection piece during the movement into the use position and wherein the guide surface slopes at an angle to the line of movement of the guide peg from the maintenance position to the use position, wherein the guide surface is oriented substantially in the same direction as spa longitudinal guide between the siphon element and the mounting element when the siphon element is in the use position.

16. A siphon arrangement comprising:

a housing with an inlet connection piece, an outlet connection piece, and a siphon seat arranged between the inlet connection piece and the outlet connection piece, and a siphon element arranged in the siphon seat, said siphon element having a siphon portion and an inlet facing toward the inlet connection piece and an outlet opening into the siphon seat, wherein water can be guided from the inlet connection piece via the inlet into the siphon portion and from the outlet into the siphon seat and then to the outlet connection piece, wherein the siphon element is mounted in the housing in such a way as to be movable from a use position to a maintenance position, and, when in the maintenance position, can be removed from the housing via an access opening, wherein the siphon element has the form of a bent tube, and wherein the siphon arrangement has a retention space, which is designed in such a way that an object situated in the tube can fall into the retention space during a rotation from the use position to the maintenance position, wherein the retention space extends outward from the siphon wall.

17. The siphon arrangement as claimed in claim 16, wherein the retention space extends outward from the siphon wall in a region of at least one of the outlet, the inlet, and the siphon seat.

* * * * *